US008668453B2

(12) United States Patent
Lee et al.

(10) Patent No.: US 8,668,453 B2
(45) Date of Patent: Mar. 11, 2014

(54) COOLING SYSTEM HAVING REDUCED MASS PIN FINS FOR COMPONENTS IN A GAS TURBINE ENGINE

(75) Inventors: Ching-Pang Lee, Cincinnati, OH (US); Nan Jiang, Jupiter, FL (US); John J. Marra, Winter Sprints, FL (US)

(73) Assignee: Siemens Energy, Inc., Orlando, FL (US)

( * ) Notice: Subject to any disclaimer, the term of this patent is extended or adjusted under 35 U.S.C. 154(b) by 468 days.

(21) Appl. No.: 13/027,323

(22) Filed: Feb. 15, 2011

(65) Prior Publication Data

US 2012/0207591 A1 Aug. 16, 2012

(51) Int. Cl.
*F01D 5/08* (2006.01)

(52) U.S. Cl.
USPC ..... 416/96 R

(58) Field of Classification Search
USPC ..... 416/90 R, 97 A
See application file for complete search history.

(56) References Cited

U.S. PATENT DOCUMENTS 4,105,364 A * 8/1978 Dodd ..... 416/97 R
6,554,571 B1 * 4/2003 Lee et al. ..... 416/92

* cited by examiner

*Primary Examiner* — Nathaniel Wiehe
*Assistant Examiner* — Kayla McCaffrey

(57) ABSTRACT

A cooling system having one or more pin fins with reduced mass for a gas turbine engine is disclosed. The cooling system may include one or more first surfaces defining at least a portion of the cooling system. The pin fin may extend from the surface defining the cooling system and may have a non-circular cross-section taken generally parallel to the surface and at least part of an outer surface of the cross-section forms at least a quartercircle. A downstream side of the pin fin may have a cavity to reduce mass, thereby creating a more efficient turbine airfoil.

14 Claims, 3 Drawing Sheets

COOLING SYSTEM HAVING REDUCED MASS PIN FINS FOR COMPONENTS IN A GAS TURBINE ENGINE

STATEMENT REGARDING FEDERALLY SPONSORED RESEARCH OR DEVELOPMENT

Development of this invention was supported in part by the United States Department of Energy, H2 Program, Contract No. DE-FC26-05NT42644. Accordingly, the United States Government may have certain rights in this invention.

FIELD OF THE INVENTION

This invention is directed generally to gas turbine engines with internal cooling systems, and more particularly to components of gas turbine engines having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades, combustor liners, and transitions must be made of materials capable of withstanding such high temperatures. In addition, turbine vanes and blades, combustor liners, and transitions often contain cooling systems for prolonging the life of the components and reducing the likelihood of failure as a result of excessive temperatures.

Typically, turbine blades are formed from an elongated portion. The blade is ordinarily composed of a leading edge, a trailing edge, a suction side, and a pressure side. The inner aspects of most turbine blades typically contain an intricate maze of cooling circuits forming a cooling system. The cooling circuits in the blades receive air from the compressor of the turbine engine and pass the blade. The cooling circuits often include multiple flow circuits that control metal temperature to ensure component durability and functionality. At least some of the air passing through these cooling circuits is exhausted through orifices in the leading edge, trailing edge, suction side, and pressure side of the blade.

Pin fin banks are commonly used within internal cooling chambers in turbine airfoils to increase heat transfer from the airfoil to the cooling fluids passing through internal cooling channels in the airfoil. In applications in which pin fin banks are utilized, the aggregate weight of the pin fins increases the centrifugal stresses on the turbine blade. The increase stresses reduce the average life of the turbine blade.

SUMMARY OF THE INVENTION

This invention relates to a cooling system having one or more pin fins with reduced mass for a gas turbine engine. The cooling system may include one or more surfaces defining at least a portion of the cooling system. The pin fin may extend from the surface defining the cooling system and may have a noncircular cross-section taken generally parallel to the surface and may be configured such that at least part of an outer surface of the cross-section forms at least a quartercircle. A downstream side of the pin fin may have a cavity to reduce mass. The cooling system may be used in various components of a gas turbine engine, such as, but not limited to, a turbine blade, a turbine vane, a transition duct and a combustion liner. When used in a turbine blade, the cooling system with reduced mass pin fins generates less centrifugal stresses, thereby creating a more efficient turbine blade.

In at least one embodiment, the cooling system may be positioned in any appropriate component in a gas turbine engine. As such, the cooling system may be formed from one or more first surfaces defining at least a portion of the cooling system and one or more pin fins extending from the surface. The pin fin may have a noncircular cross-section taken generally parallel to the at least one first surface, wherein at least part of an outer surface of the cross-section forms at least a quartercircle.

In another embodiment, the cooling system may be positioned in an airfoil for a gas turbine engine. The airfoil may be formed from a generally elongated hollow airfoil formed from an outer wall, and having a leading edge, a trailing edge, a pressure side wall, a suction side wall positioned generally opposite from the pressure side wall. The cooling system in the generally elongated hollow airfoil, may include at least one first surface defining at least a portion of the cooling system and at least one pin fin extending from the at least one surface. The pin fin may have a noncircular cross-section taken generally parallel to the at least one first surface, wherein at least part of an outer surface of the cross-section forms at least a quartercircle.

The pin fins may have one or more configurations configured to reduce mass, thereby creating a more efficient component. In particular, the pin fins may have a noncircular cross-section taken generally parallel to the surface. The noncircular cross-section may include a portion that forms at least a quartercircle. One or more pin fins may include one or more semicircular outer surfaces positioned on an upstream side of the pin fin. The pin fin may include a concave downstream surface coupled to the semicircular outer surface. Such a configuration of the pin fin may have a necessary width of the cross-section to create a designed for accelerated flow rate while having reduced mass compared with conventional solid pin fins with circular cross-sections. The cavity may create a reduction in mass in the pin fin.

In another embodiment, one or more pin fins may include one or more semicircular outer surfaces positioned on an upstream side of the pin fin and may include a semicircular, concave downstream surface. Linear surfaces may extend between the semicircular outer surface and the semicircular, concave downstream surface. The semicircular, concave downstream surface may create a cavity that reduces mass.

In yet another embodiment, one or more pin fins may include a three quarter circular outer surface positioned on an upstream side of the pin fin. The pin fin may also include two generally linear sides positioned on a downstream side of the pin fin and forming a one quarter, pie shaped cavity. In another embodiment, one or more pin fins may include a three quarter circular downstream surface forming a three quarter circular cavity within the pin fin. The three quarter downstream surface may be coupled to the three quarter circular outer surface with linear surfaces or surfaces with other configurations.

In still another embodiment, one or more pin fins may include a first section and a second section divided by a cavity generally aligned with a longitudinal axis of cooling fluid flow. The pin fin may include one or more semicircular outer surfaces positioned on the first section and one or more semicircular outer surfaces positioned on the second section. The first section may include a concave inner surface and the second section may include a concave inner surface, wherein the concave inner surfaces are opposed to each other.

In another embodiment, one or more pin fins may include a first section and a second section divided by a cavity generally aligned with a longitudinal axis of cooling fluid flow. The pin fin may include one or more semicircular outer surfaces positioned on the first section and one or more semicircular outer surfaces positioned on the second section. The first section may include a concave, semicircular inner surface and the second section may include a concave, semicircular inner surface, wherein the concave, semicircular inner surfaces may be opposed to each other.

In yet another embodiment, one or more pin fins may include first and second sections. The first section may include one or more three eights circular outer surfaces positioned on an upstream side of the first section. The second section may include one or more three eights circular outer surfaces positioned on an upstream side of the second section. The first section may further include a generally linear side surface positioned on a downstream side of the first section. The second section may further include a generally linear side surface positioned on a downstream side of the second section. The downstream, generally linear sides of the first and second sections may form a one quarter, pie shaped cavity.

In yet another embodiment, one or more pin fins may include first and second sections. The first section may include one or more three eights circular outer surfaces positioned on an upstream side of the first section. The second section may include one or more three eights circular outer surfaces positioned on an upstream side of the second section. The first section may further include a three eights circular downstream surface forming an inner curved surface coupled to the three eights circular outer surface with a linear surface. The second section may include a three eights circular downstream surface forming an inner curved surface coupled to the three eights circular outer surface with a linear surface.

An advantage of this invention is that the pin fins may be used to create a pin fin bank within a cooling system for a turbine engine to accelerate the flow rate of cooling fluids and to increase heat transfer to the cooling fluids through convection occurring on the increased surface area of the pin fins.

Another advantage of this invention is that the pin fins have reduced mass as compared with conventional pin fins having cylindrical pin fins.

Yet another advantage of this invention is that the pin fins is that the reduced mass of the pin fins creates less centrifugal stresses in turbine blades attached to a rotor assembly and rotating during turbine engine operation.

Another advantage of this invention is that the center cavity positioned between two sections of a pin fin further reduces the mass of the pin fin while maintaining a substantially similar cooling fluid flow schematic.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
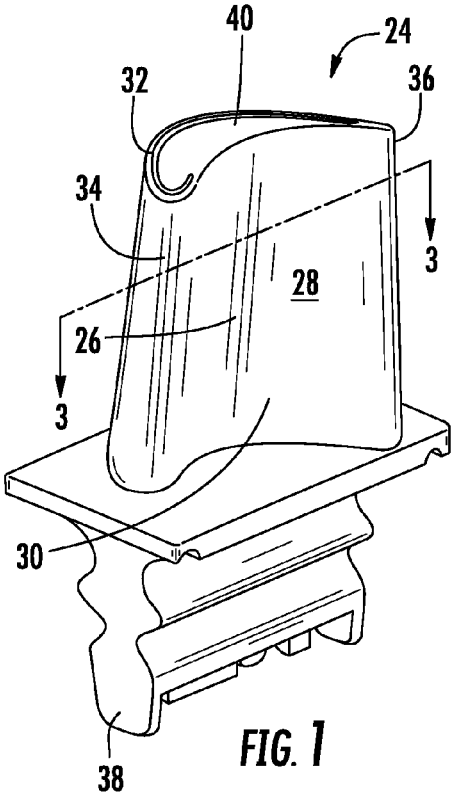
FIG. 1 is a perspective view of a turbine airfoil having features according to the instant invention.

As shown in FIGS. 1-11, this invention is directed to a cooling system 10 having one or more pin fins 12 with reduced mass for a gas turbine engine. The cooling system 10 may include one or more surfaces 14 defining at least a portion of the cooling system 10. The pin fin 12 may extend from the surface 14 defining the cooling system 10 and may have a noncircular cross-section 16 taken generally parallel to the surface 14 and at least part of an outer surface 18 of the cross-section 16 forms at least a quartercircle. A downstream side 20 of the pin fin may have a cavity 22 to reduce mass. The cooling system 10 may be used in various components of a gas turbine engine, such as, but not limited to, a turbine blade 24, a turbine vane, a transition duct and a combustion liner. When used in a turbine blade, the cooling system 10 with reduced mass pin fins 12 generates less centrifugal stresses, thereby creating a more efficient turbine blade 24.

Figure 2:
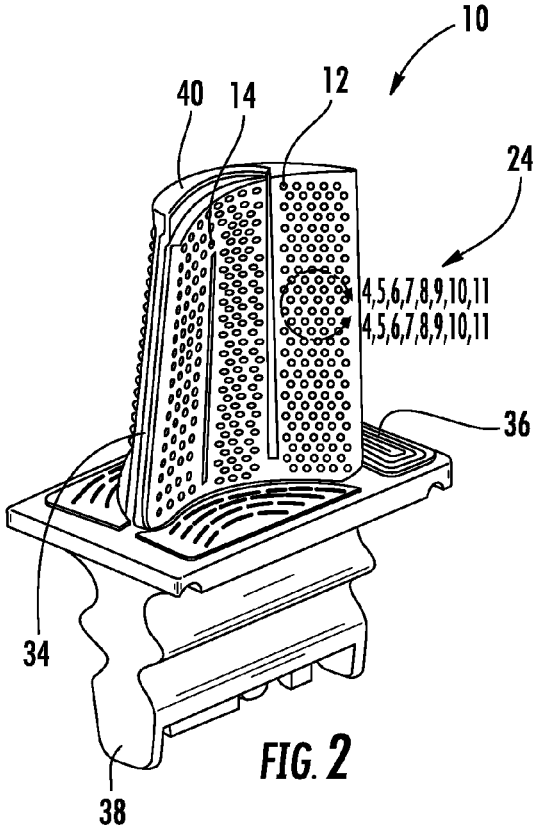
FIG. 2 is a perspective view of a turbine airfoil with gaspath surfaces removed displaying a core of the airfoil with pin fins extending therefrom.
Figure 3:
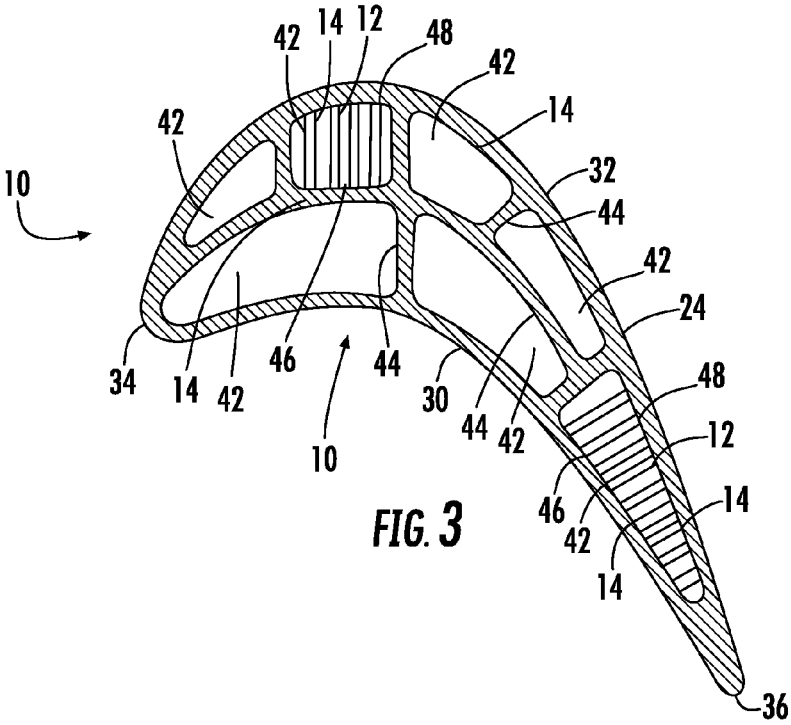
FIG. 3 is a cross-sectional view of the turbine airfoil taken along section line 3-3 in FIG. 1.

In one embodiment, the cooling system 10 may be positioned within a turbine blade 24, as shown in FIGS. 1 and 2. The turbine blade 24 may be formed from a generally elongated, hollow airfoil 26 having an outer surface 28 adapted for use, for example, in an axial flow turbine engine. The outer surface 28 may have a generally concave shaped portion forming a pressure side wall 30 and a generally convex shaped portion forming a suction side wall 32 that is positioned generally opposite to the pressure side wall 30. The airfoil 26 may extend generally chordwise from a leading edge 34 to a trailing edge 36. The turbine blade 24 may include the cooling system 10 positioned within internal aspects of the turbine blade 24. The cooling system 10 may have any appropriate configuration that is configured based upon factors, including, but not limited to, heat transfer coefficients, temperature, pressure, cooling load and the like. In at least one embodiment, as shown in FIGS. 1-3, the cooling system 10 may be formed from a seven pass serpentine cooling system 10 that transfers cooling fluids through a plurality of cooling channels 42 extending from a root 38 of the turbine blade 24 to the tip 40 or in shorter lengths, in a generally spanwise direction. The cooling channels 42 may be formed from a plurality of ribs 44.

The cooling channels 42 may include one or more pin fins 12 positioned therein. In at least one embodiment, the cooling system 10 may include a plurality of pin fins 12. The pin fins 12 may be formed from any appropriate materials, such as conventional materials and heretofore unidentified materials or combinations of materials. The pin fins 12 may extend from a first inner surface 46 to a second inner surface 48. In at least one embodiment, as shown in FIG. 3, the first and second inner surfaces 46, 48 may face each other forming opposite sides of the cooling channel 42 and may be positioned generally parallel to each other. The pin fins 12 may extend generally orthogonally from the inner surfaces 46, 48 forming the cooling channels 42 and may be supported by both inner surfaces 46, 48.

Figure 4:
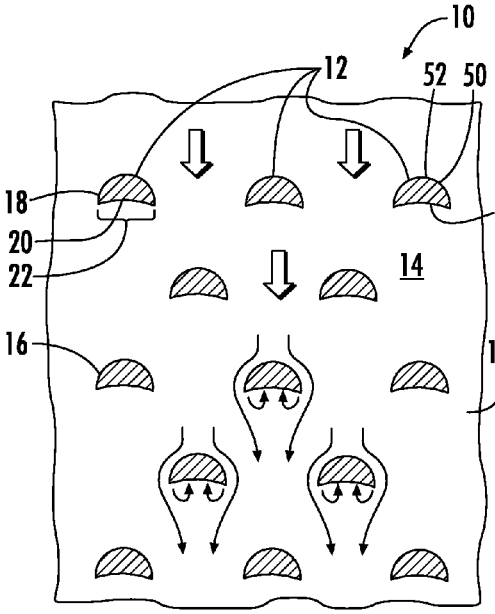
FIG. 4 is a detailed view of a pin fin bank taken at detail line 4-4 in FIG. 2.

The pin fins 12 may have one or more configurations configured to reduce mass, thereby creating a more efficient component. In particular, FIGS. 4-11 disclose a plurality of alternative configurations of cross-sections 16 for pin fins 12. The pin fins 12 may have a noncircular cross-section 16 taken generally parallel to the surface 14. The noncircular cross-section 16 includes a portion that forms at least a quarter-circle. As shown in FIG. 4, one or more pin fins 12 may include one or more semicircular outer surfaces 50 positioned on an upstream side 52 of the pin fin 12. The pin fin 12 may include a concave downstream surface 54 coupled to the semicircular outer surface 50. The downstream surface 54 of the pin fin 12 may also be generally linear, convex or have other appropriate configurations. Such a configuration of the pin fin 12 may have a necessary width of the cross-section 16 to create a designed for accelerated flow rate while having reduced mass compared with conventional solid pin fins with circular cross-sections. The cavity 60 may create a reduction in mass in each pin fin 12.

Figure 5:
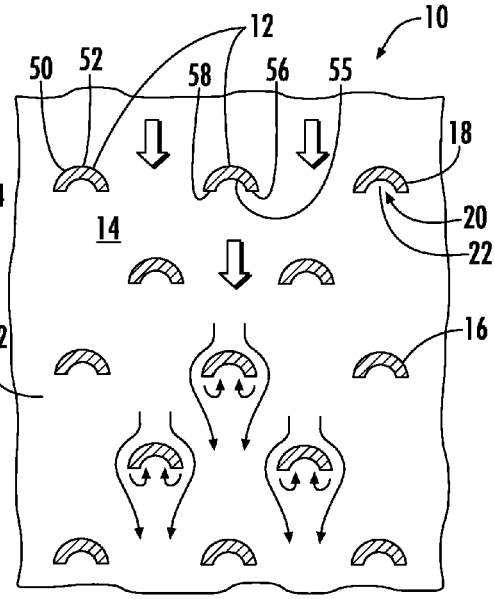
FIG. 5 is a detailed view of an alternative pin fin bank taken at detail line 5-5 in FIG. 2.

In another embodiment, as shown in FIG. 5, one or more pin fins 12 may include one or more semicircular outer surfaces 50 positioned on an upstream side 52 of the pin fin 12 and may include a semicircular, concave downstream surface 55.

Linear surfaces 56, 58 may extend between the semicircular outer surface 50 and the semicircular, concave downstream surface 55. The semicircular, concave downstream surface 55 may create a cavity 22 that reduces mass in the pin fin 12.

Figure 6:
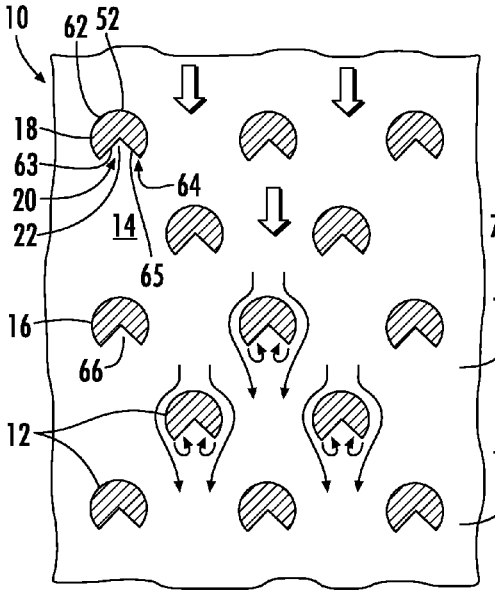
FIG. 6 is a detailed view of another alternative pin fin bank taken at detail line 6-6 in FIG. 2.

In yet another embodiment, as shown in FIG. 6, one or more pin fins 12 may include a three quarter circular outer surface 62 positioned on an upstream side 52 of the pin fin 12. The pin fin 12 may also include two generally linear sides 63, 65 positioned on a downstream side 64 of the pin fin 12 and forming a one quarter, pie shaped cavity 66.

Figure 7:
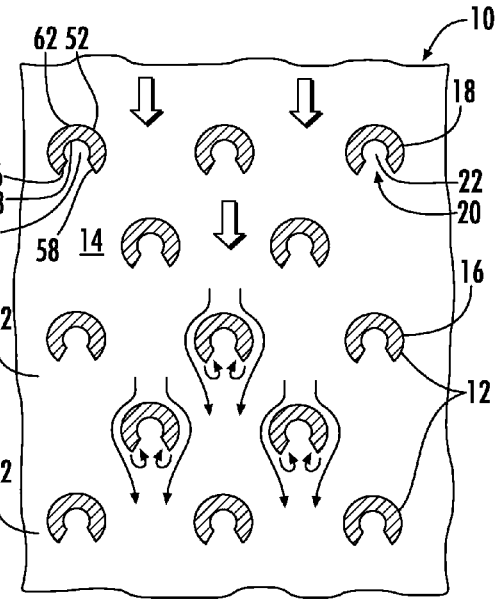
FIG. 7 is a detailed view of yet another alternative pin fin bank taken at detail line 7-7 in FIG. 2.

In another embodiment, as shown in FIG. 7, one or more pin fins 12 may include a three quarter circular outer surface 62 positioned on an upstream side 52 of the pin fin 12. The pin fin 12 may include a three quarter circular downstream surface 68 forming a three quarter circular cavity 70 within the pin fin 12. The three quarter downstream surface 68 may be coupled to the three quarter circular outer surface 62 with linear surfaces 56, 58.

Figure 8:
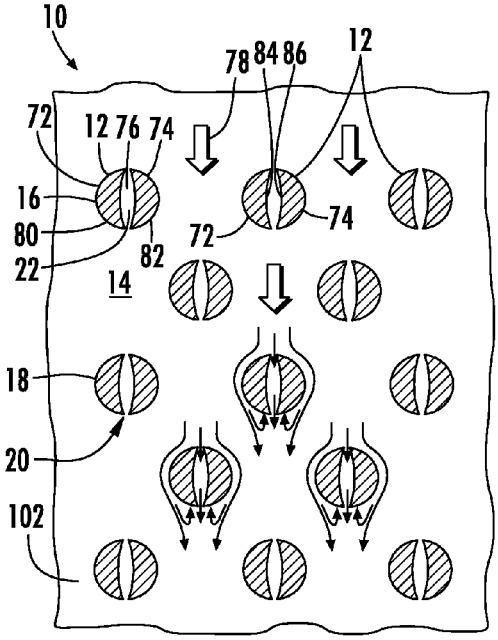
FIG. 8 is a detailed view of another alternative pin fin bank taken at detail line 8-8 in FIG. 2.

In still another embodiment, as shown in FIG. 8, one or more pin fins 12 may include a first section 72 and a second section 74 divided by a cavity 76 generally aligned with a longitudinal axis 78 of cooling fluid flow. The pin fin 12 may include one or more semicircular outer surfaces 80 positioned on the first section 72 and one or more semicircular outer surfaces 82 positioned on the second section 74. The first section 72 may include a concave inner surface 84 and the second section 74 may include a concave inner surface 86, wherein the concave inner surfaces 84, 86 are opposed to each other.

Figure 9:
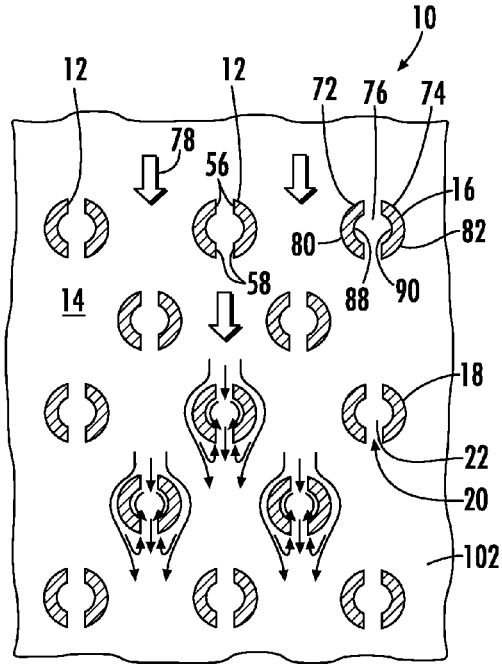
FIG. 9 is a detailed view of still another alternative pin fin bank taken at detail line 9-9 in FIG. 2.

In another embodiment, as shown in FIG. 9, one or more pin fins 12 may include a first section 72 and a second section 74 divided by a cavity 76 generally aligned with a longitudinal axis 78 of cooling fluid flow. The pin fin 12 may include one or more semicircular outer surfaces 80 positioned on the first section 72 and one or more semicircular outer surfaces 82 positioned on the second section 74. The first section 72 may include a concave, semicircular inner surface 88 and the second section 74 may include a concave, semicircular inner surface 90, wherein the concave, semicircular inner surfaces 90 may be opposed to each other. The concave, semicircular inner surfaces 88 and 90 may be coupled to the semicircular outer surfaces with lateral surfaces 56, 58.

Figure 10:
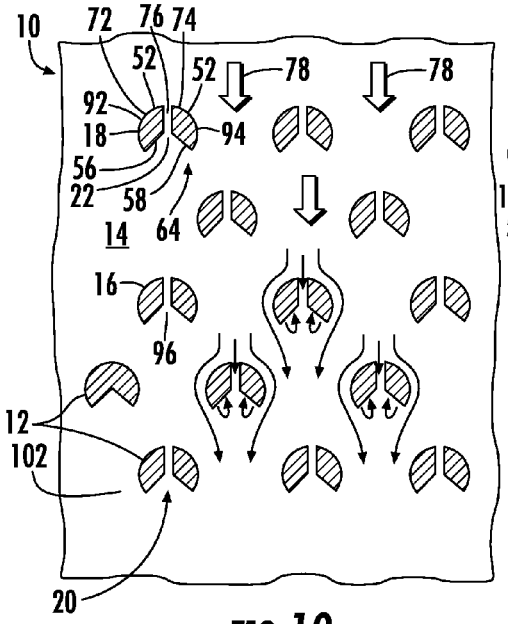
FIG. 10 is a detailed view of another alternative pin fin bank taken at detail line 10-10 in FIG. 2.

In yet another embodiment, as shown in FIG. 10, one or more pin fins 12 may include first and second sections 72, 74. The first section 72 may include one or more three eights circular outer surfaces 92 positioned on an upstream side 52 of the first section 72. The second section 74 may include one or more three eights circular outer surfaces 94 positioned on an upstream side 52 of the second section 74. The first section 72 may further include a generally linear side surface 56 positioned on a downstream side 64 of the first section 72. The second section 74 may further include a generally linear side surface 58 positioned on a downstream side 64 of the second section 74. The downstream, generally linear sides 56, 58 of the first and second sections 72, 74 may form a one quarter, pie shaped cavity 96.

Figure 11:
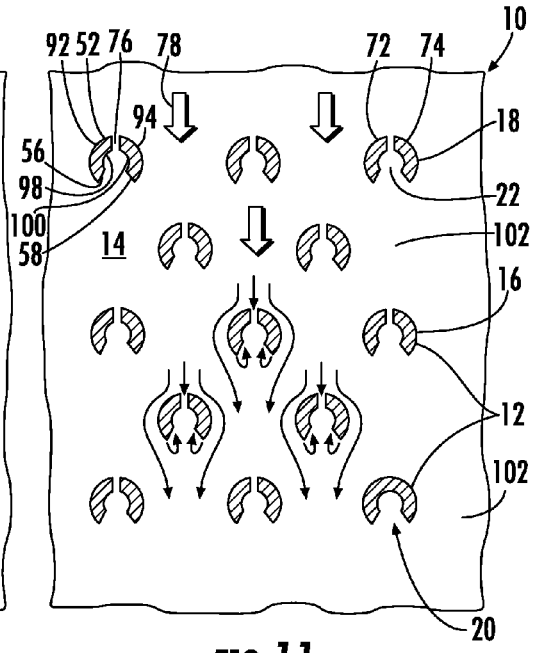
FIG. 11 is a detailed view of yet another alternative pin fin bank taken at detail line 11-11 in FIG. 2.

In yet another embodiment, as shown in FIG. 11, one or more pin fins 12 may include first and second sections 72, 74. The first section 72 may include one or more three eights circular outer surfaces 92 positioned on an upstream side 52 of the first section 72. The second section 74 may include one or more three eights circular outer surfaces positioned on an upstream side 52 of the second section 74. The first section 72 may further include a three eights circular downstream surface 98 forming an inner curved surface coupled to the three eights circular outer surface 92 with a linear surface 56. The second section 74 may include a three eights circular downstream surface 100 forming an inner curved surface coupled to the three eights circular outer surface 94 with a linear surface 58.

As previously set forth, the cooling system 10 may be positioned in a turbine blade 24. The turbine blade 24 may include one or more pin fins 12. In at least one embodiment, the turbine blade 24 may include a plurality of pin fins 12 collected into pin fin banks. In most situations, the pin fins 12 may extend from the pressure side wall 30 to a suction side wall 32. In some embodiments, the pin fins 12 may not extend from the pressure side wall 30 to the suction side wall 32 but may instead extend from the pressure side wall 30 or the suction side wall 32 to an internal rib 44 in much the same direction. The pin fins 12 may be positioned into rows 102. The pin fins 12 may be aligned with pins fins 12 in adjacent rows 102 or may be offset. The turbine blade 24 may be configured such that one or more pin fin banks may include one or more alternative pin fin 12 configurations, as shown in FIGS. 4-11. The turbine blade 24 may include rows 102 having a single configuration of pin fins 12 or two or more configurations of pin fins 12. Adjacent rows 102 of pin fins 12 in the turbine blade 24 may include pin fins 12 with the same configuration or two or more different configurations. Additionally, pin fins 12 located in different regions of the turbine blade 24 may have different configurations.

During use, cooling fluids are passed through the cooling system 12 to cool the component in which the cooling system is positioned. The cooling fluids contact the pin fins 12 and increase in temperature due to convection, thereby reducing the temperature of the pin fins 12. Because of conduction within the turbine blade 24, the pin fins 12 are able to reduce the temperature of the turbine blade 24 in the area surrounding the pin fins 12.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A cooling system for a gas turbine engine, comprising:

at least one first surface defining at least a portion of the cooling system; and at least one pin fin extending from the at least one first surface;

wherein the at least one pin fin has a noncircular cross-section taken generally parallel to the at least one first surface, wherein at least part of an outer surface of the cross-section forms at least a quartercircle;

wherein the at least one pin fin comprises at least one three quarter circular outer surface positioned on an upstream side of the at least one pin fin;

wherein the at least one pin fin includes a three quarter circular downstream surface forming a three quarter circular cavity within the at least one pin fin, wherein the three quarter downstream surface is coupled to the outer surface with linear surfaces.

2. A cooling system for a gas turbine engine, comprising:

at least one first surface defining at least a portion of the cooling system; and at least one pin fin extending from the at least one first surface to a second inner surface;

wherein the at least one pin fin has a noncircular cross-section taken generally parallel to the at least one first surface, wherein at least part of an outer surface of the cross-section forms at least a quartercircle;

wherein the at least one pin fin is formed from first and second sections divided by a cavity generally aligned with a longitudinal axis of cooling fluid flow.

3. The cooling system of claim 2, wherein the at least one pin fin comprises at least one semicircular outer surface positioned on the first section and at least one semicircular outer surface positioned on the second section.

4. The cooling system of claim 3, wherein the first section includes a concave inner surface and the second section includes a concave inner surface, wherein the concave inner surfaces are opposed to each other.

5. The cooling system of claim 3, wherein the first section includes a concave, semicircular inner surface and the second section includes a concave, semicircular inner surface, wherein the concave, semicircular inner surfaces are opposed to each other.

6. The cooling system of claim 2, wherein the first section comprises at least one three eights circular outer surface positioned on an upstream side of the first section, and the second section comprises at least one three eights circular outer surface positioned on an upstream side of the second section.

7. The cooling system of claim 6, wherein the first section further comprises a generally linear side surface positioned on a downstream side of the first section, and the second section further comprises a generally linear side surface positioned on a downstream side of the second section, wherein the downstream, generally linear sides of the first and second sections form a one quarter, pie shaped cavity.

8. The cooling system of claim 6, wherein the first section includes a three eights circular downstream surface forming an inner curved surface coupled to the outer surface with a linear surface, and the second section includes a three eights circular downstream surface forming an inner curved surface coupled to the outer surface with a linear surface.

9. An airfoil for a gas turbine engine, comprising:

a generally elongated hollow airfoil formed from an outer wall, and having a leading edge, a trailing edge, a pressure side wall, a suction side wall positioned generally opposite from the pressure side wall;

a cooling system in the generally elongated hollow airfoil, comprising at least one first surface defining at least a portion of the cooling system; and at least one pin fin extending from the at least one first surface and contacting a second inner surface;

wherein the at least one pin fin has a noncircular cross-section taken generally parallel to the at least one first surface, wherein at least part of an outer surface of the cross-section forms at least a quartercircle;

wherein the at least one pin fin comprises at least one three quarter circular outer surface positioned on an upstream side of the at least one pin fin and includes a three quarter circular downstream surface forming a three quarter circular cavity within the at least one pin fin, wherein the three quarter downstream surface is coupled to the outer surface with linear surfaces.

10. An airfoil for a gas turbine engine, comprising:

a generally elongated hollow airfoil formed from an outer wall, and having a leading edge, a trailing edge, a pressure side wall, a suction side wall positioned generally opposite from the pressure side wall;

a cooling system in the generally elongated hollow airfoil, comprising at least one first surface defining at least a portion of the cooling system; and at least one pin fin extending from the at least one first surface and contacting a second inner surface;

wherein the at least one pin fin has a noncircular cross-section taken generally parallel to the at least one first surface, wherein at least part of an outer surface of the cross-section forms at least a quartercircle;

wherein the at least one pin fin is formed from first and second sections divided by a cavity generally aligned with a longitudinal axis of cooling fluid flow.

11. The airfoil of claim 10, wherein the at least one pin fin comprises at least one semicircular outer surface positioned on the first section and at least one semicircular outer surface positioned on the second section, wherein the first section includes a concave inner surface and the second section includes a concave inner surface, wherein the concave inner surfaces are opposed to each other.

12. The airfoil of claim 10, wherein the at least one pin fin comprises at least one semicircular outer surface positioned on the first section and at least one semicircular outer surface positioned on the second section, wherein the first section includes a concave, semicircular inner surface and the second section includes a concave, semicircular inner surface, wherein the concave, semicircular inner surfaces are opposed to each other.

13. The airfoil of claim 10, wherein the first section comprises at least one three eights circular outer surface positioned on an upstream side of the first section, and the second section comprises at least one three eights circular outer surface positioned on an upstream side of the second section, wherein the first section further comprises a generally linear side surface positioned on a downstream side of the first section, and the second section further comprises a generally linear side surface positioned on a downstream side of the second section, wherein the downstream, generally linear sides of the first and second sections form a one quarter, pie shaped cavity.

14. The airfoil of claim 10, wherein the first section comprises at least one three eights circular outer surface positioned on an upstream side of the first section, and the second section comprises at least one three eights circular outer surface positioned on an upstream side of the second section, wherein the first section includes a three eights circular downstream surface forming an inner curved surface coupled to the outer surface with a linear surface, and the second section includes a three eights circular downstream surface forming an inner curved surface coupled to the outer surface with a linear surface.

* * * * *